US005495936A

United States Patent [19]

Kuwabara

[11] Patent Number: 5,495,936

[45] Date of Patent: Mar. 5, 1996

[54] DEVICE AND METHOD FOR FORMING AND RETAINING WATERDROPS

[75] Inventor: Junichi Kuwabara, Osaka, Japan

[73] Assignee: Clover Manufacturing Co. Ltd., Osaka, Japan

[21] Appl. No.: 296,186

[22] Filed: Aug. 29, 1994

[30] Foreign Application Priority Data

Apr. 8, 1994 [JP] Japan ..... 6-070907

[51] Int. Cl.[6] ..... B05C 17/00; B44D 3/06

[52] U.S. Cl. ..... 206/1.7; 137/561 A; 137/571

[58] Field of Search ..... 137/571, 561 A; 206/1.7, 1.8

[56] References Cited

U.S. PATENT DOCUMENTS

| | | | |
|---|---|---|---|
| 748,026 | 12/1903 | Sussmilch | 206/1.7 |
| 791,672 | 6/1905 | Cochrane | 206/1.8 |
| 1,322,682 | 11/1919 | Erickson | 137/571 X |
| 3,606,912 | 9/1971 | Fox | 137/571 X |
| 3,786,913 | 1/1974 | Crawford | 206/1.8 |
| 3,815,265 | 6/1974 | DePenn | 206/1.7 X |
| 3,945,490 | 3/1976 | Thompson | 206/1.7 |
| 5,182,082 | 1/1993 | Monthony et al. | 137/561 A X |

FOREIGN PATENT DOCUMENTS

| | | | |
|---|---|---|---|
| 601664 | 8/1934 | Germany | 206/1.8 |
| 377787 | 8/1932 | United Kingdom | 206/1.8 |

*Primary Examiner*—Bryon P. Gehman

*Attorney, Agent, or Firm*—Michael D. Bednarek; Marks & Murase

[57] ABSTRACT

A device for forming and retaining waterdrops is provided which comprises a water passage surface formed with a plurality of waterdrop retaining recesses. In use, water is supplied to the water passage surface and then drained off. As a result, waterdrops can be formed at the respective waterdrop retaining recesses.

13 Claims, 7 Drawing Sheets

DEVICE AND METHOD FOR FORMING AND RETAINING WATERDROPS

BACKGROUND OF THE INVENTION

1. Field of the Invention

This invention relates to a device for forming and retaining waterdrops for use in painting. The present invention also relates to a method of forming and retaining waterdrops.

2. Description of the Related Art

In recent years, a painting technique called "tole painting" is widely used in handicraft and technical art. The tole painting, which was traditionally used by professional technical artist for decoratively painting pieces of furniture, tinplate products or the like, is now practiced by hobbyists as well.

In tole painting, a method called "side loading" is used to form a shade-off line for providing improved decorative effects. For the convenience of description, reference is now made to FIGS. 8 and 9 which show a typical prior art side loading method.

As shown in FIGS. 8 and 9, the prior art side loading method utilizes a flat brush 50 having a flattened bristle portion 51. First, a paint 52 is deposited on a palette 53. Then, the tail end 50*x* of the brush handle is dipped in water (in an unillustrated container) and brought into contact with the palette 53 to form a waterdrop 54. Then, one tip corner 51*a* of the bristle portion 51 is made to pick up a portion of the paint deposit 52. Then, the other tip corner 51*b* of the bristle portion 51 is brought into contact with the waterdrop 54 for wetting. Finally, the whole tip of the bristle portion 51 is pressed against an article surface AS and moved laterally thereon. As a result, a line L having a shade-off portion L1 is formed on the article surface AS.

The prior art side loading method described above has been found disadvantageous in the following respects.

First, as the tole painting proceeds, the operative surface of the palette 53 is occupied by deposits of variously colored paints. As a result, the area of the palette surface available for the waterdrop or a new waterdrop reduces, and it is more likely that the waterdrop is contaminated by the nearby paints.

Secondly, since the water container (not shown) is used commonly for washing the paint off the brush 50 and for forming a waterdrop, the waterdrop may be contaminated also for this reason.

In the third place, it is rather time-taking and troublesome to use the tail end 50*x* of the brush 50 for forming a waterdrop because it is necessary to wipe the remaining water off the brush in addition to the need for changing the orientation of the brush.

SUMMARY OF THE INVENTION

It is, therefore, an object of the present invention to provide a waterdrop forming and retaining device which is capable of conveniently forming and retaining clean (or clear) waterdrops advantageously usable for side loading in tole painting.

Another object of the present invention to provide a method for conveniently forming and retaining clean waterdrops.

According to one aspect of the present invention, there is provided a device for forming and retaining waterdrops comprising: a water passage surface for flowing of water; a plurality of waterdrop retaining recesses formed in the water passage surface; and means for removably supplying water to the water passage surface to form waterdrops at the respective waterdrop retaining recesses.

The device described above is specially designed for forming and retaining a plurality of waterdrops at a time. There is no need to form a waterdrop by using the tail end of a brush handle every time side loading is performed in tole painting.

Further, the water supply means may be used exclusively to supply water only for forming waterdrops (but not for diluting paints). Thus, there is no likelihood that waterdrops are unexpectedly colored after repetitive use of the device.

Preferably, the water passage surface may be rendered water-repellent to make sure that the formed waterdrops are reliably rounded or bulged due to the surface tension of water.

It is further preferable that the water supplying means comprise at least one water reservior for containing water to a level normally lower than the water passage surface.

According to a preferred embodiment of the present invention, the water passage surface and the water reservior constitute different parts of an integral case, whereby water from the reservior is supplied to the water passage surface by tilting the case. Such tilting of the case may be conveniently performed if the case is supported by a plurality of elastic support members, because the support members may be elastically compressed for tilting.

Advantageously, the water passage surface may be formed with a linear water guide groove at which the waterdrop retaining recesses are formed in a row extending along the groove. In this case, the water supplying means may preferably comprise a pair of water reserviors at respective ends of the water guide groove for containing water to a level lower than the water passage surface.

Alternatively, the water passage surface may be formed with a row of water guide grooves, and the waterdrop retaining recesses may be formed at the respective water guide grooves. In this case again, the water supplying means preferably comprise a pair of water reserviors transversely on both sides of the row of water guide grooves for containing water to a level lower than the water passage surface.

According to another embodiment of the present invention, the water passage surface is provided by a movable plate which is movable between a first position above the water level and a second position below the water level in the water reservior. The movable plate may be supported on an elastic absorbent member and formed with a strip-like projection for manually pressing the movable plate downward. Further, the movable plate may preferably have a specific weight which is smaller than the specific weight of water.

Alternatively, the movable plate may be supported on a support shelf adjacent to the water reservior in the second position. In this case, the water reservior may be provided with a pair of cutouts, whereas the movable plate may be provided with a corresponding pair of handle rods fitted in the pair of cutouts in the first position of the movable plate.

According to a further embodiment of the present invention, the water passage surface is provided in an annular form by a ring provided in a cup-shaped case, and the case has a bottom wall formed with a plurality of perforations which work as the water supplying means. For convenience, the case may be further provided with a handle.

According to another aspect of the present invention, there is provided a device for forming and retaining waterdrops comprising an upwardly open case which has a pair of water reserviors, the case further having a water guide groove connecting between the pair of water reserviors, the water guide groove being formed with a series of waterdrop retaining recesses spaced along the groove, the water guide groove having a bottom located higher than a bottom portion of each of the water reserviors.

According to a further aspect of the present invention, there is provided a method for forming and retaining waterdrops comprising the steps of: supplying water onto a water passage surface which is formed with a plurality of waterdrop retaining recesses; and draining the thus supplied water from the water passage surface to form waterdrops at the respective waterdrop retaining recesses.

Other objects, features and advantages of the present invention will be fully understood from the following detailed description given with reference to the accompanying drawings.

DETAILED DESCRIPTION OF THE PREFERRED EMBODIMENTS

Figure 1:
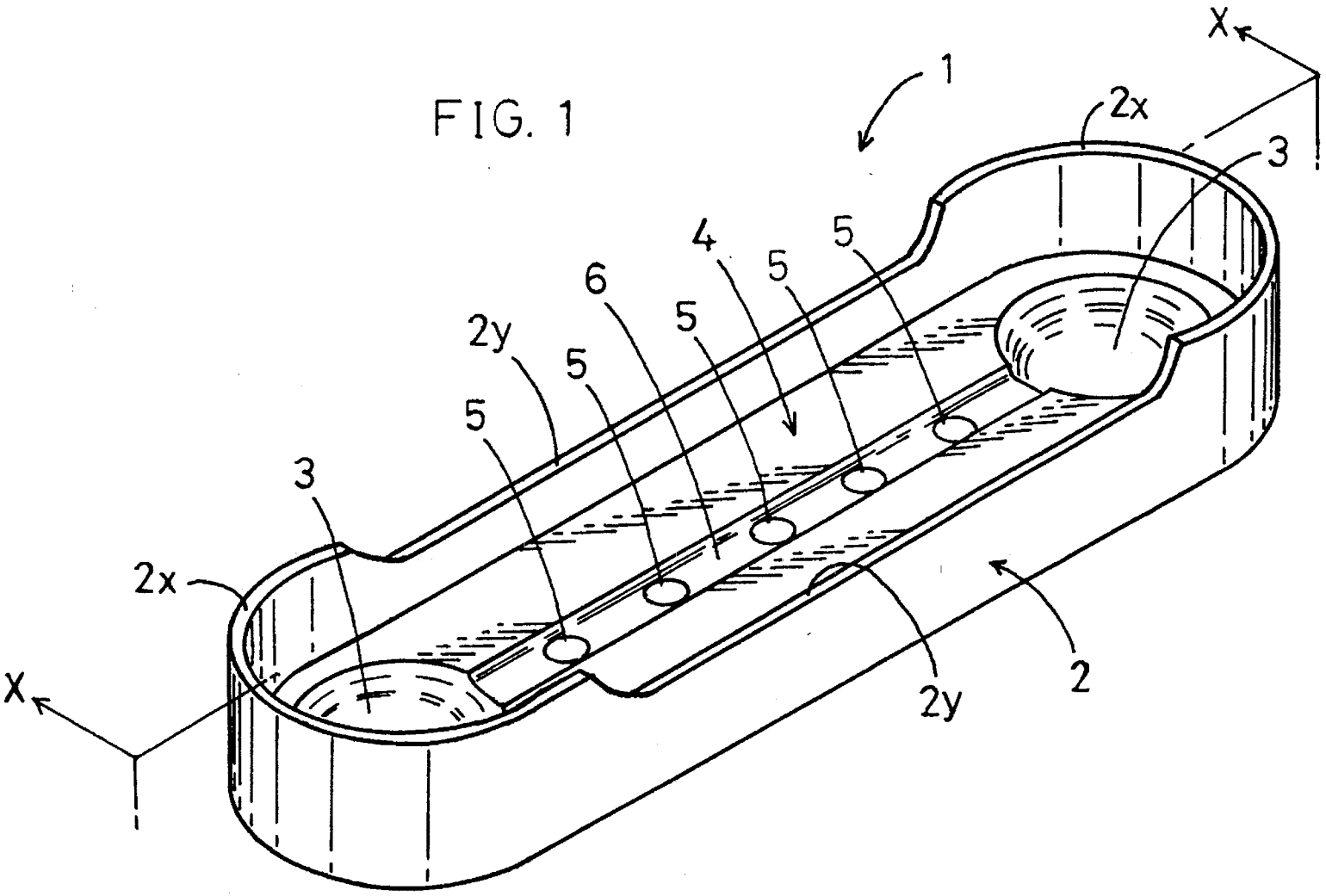
FIG. 1 is a perspective view showing a waterdrop forming and retaining device according to a first embodiment of the present invention.
Figure 2:
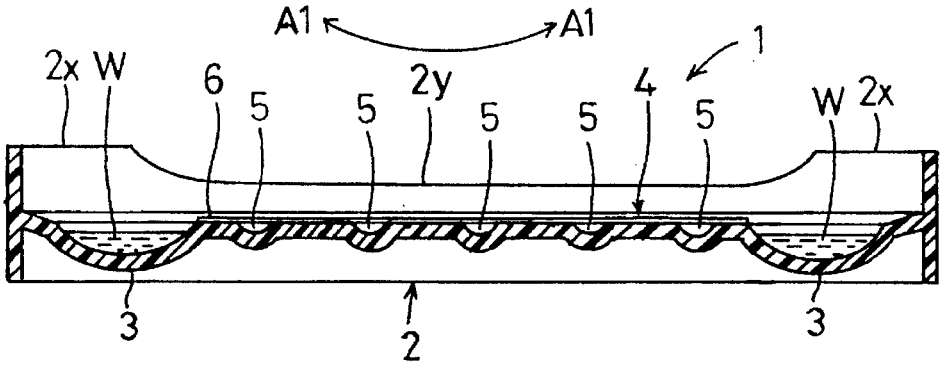
FIG. 2 is a sectional view taken on lines X—X in FIG. 1.

FIGS. 1 and 2 of the accompanying drawings show a waterdrop forming and retaining device (hereafter referred simply as "waterdrop device") according to a first embodiment of the present invention. The waterdrop device, generally represented by reference numeral 1, comprises an upwardly open elongate case 2 which has a pair of water reserviors 3 at both ends thereof. The case further has a water passage surface 4 located slightly above the respective water reserviors 3 and connecting therebetween.

The water passage surface 4 is centrally formed with a series of diametrically small waterdrop, retaining recesses 5 arranged at suitable spacing along a linear water guide groove 6 which connects between the pair of water reserviors 3. The water passage surface 4 may be inclined slightly downwardly toward the water guide groove 6.

Each of the water reserviors 3 is a partially spherical recess which has a relatively large diameter. The water reservior 3 contains an amount of supply water W (see FIG. 2) such that the water surface is located slightly below the water guide groove 6.

The case 2 has a pair of higher end wall portions 2*x* and a pair of lower side wall portions 2*y*. Apparently, such an arrangement is effective for preventing the water W from overflowing the higher end wall portions 2*x*.

Preferably, the case 2 may be formed integrally of a water repellent material. Examples of economical material meeting this requirement include polyethylene and polypropylene.

Alternatively, the portions of the case 1 providing the water passage surface 4, the water reserviors 3 and the water guide groove 6 may be formed of a water repellent material separately from the remaining portions of the case 1 which may not be made of a water-repellent.

In use, the user manually holds the case 2 and longitudinally tilts it to make one of the water reserviors 3 higher than the other. As a result, a part (or all) of the supply water W in the higher reservior flows down on the water passage surface 4 into the lower reservior. If necessary, the case 2 may be repetitively inclined (or swung) back and forth, as indicated by arrows A1—A1 in FIG. 2.

When water flows on the water passage surface 4, a part of it will pass the water guide groove 6 so that a small amount of water is inevitably left in each of the waterdrop retaining recesses 5, thereby forming a waterdrop. The waterdrop (not shown in FIGS. 1 and 2) thus formed is still retained in each of the waterdrop retaining recesses even after the case 1 is returned to its horizontal posture.

Figure 9:
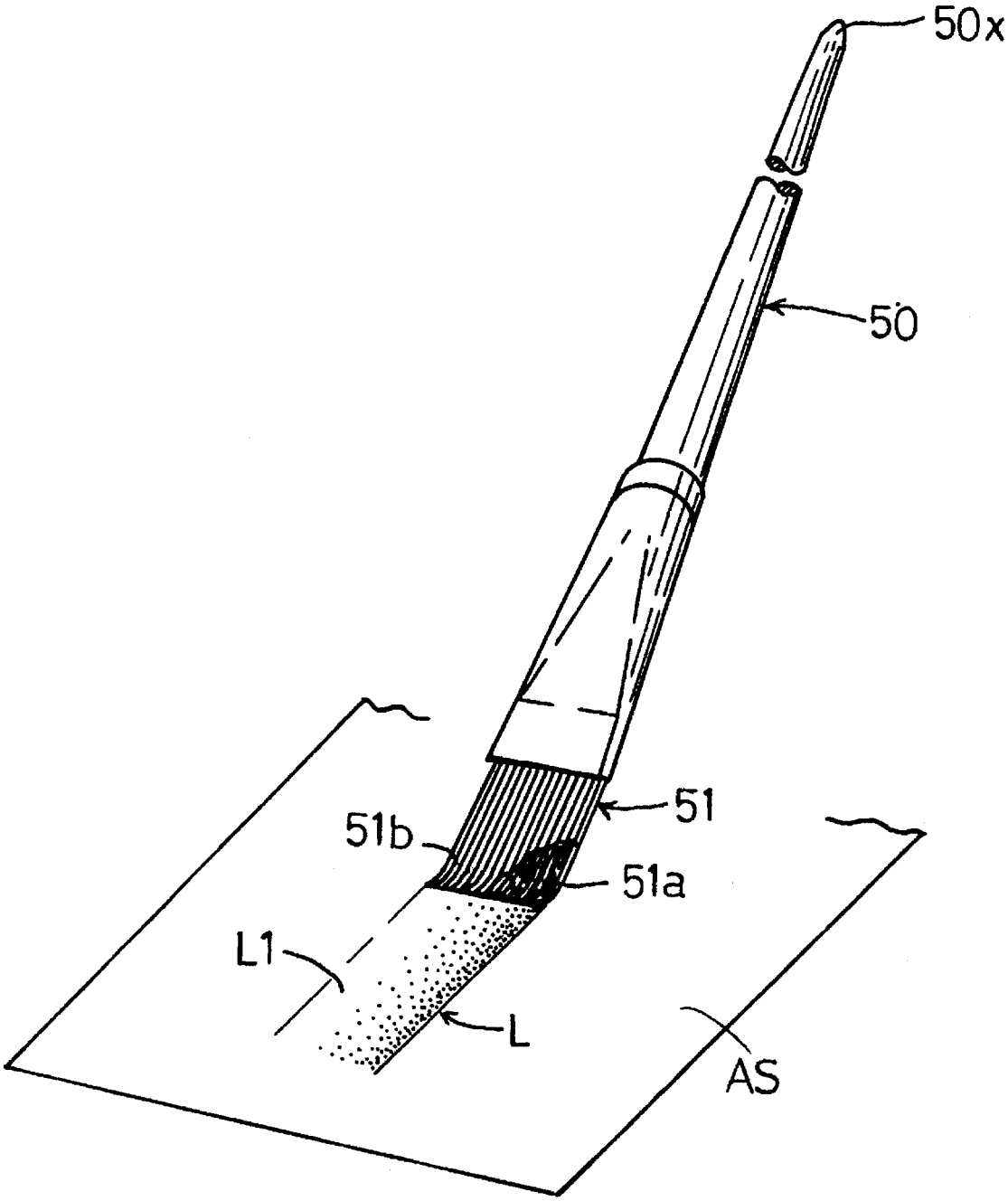
FIG. 9 Prior Art
FIG. 9 is a perspective view showing how a waterdrop is used for tole painting.

In tole painting, use is made of a flat brush 50 having a bristle portion 51, as shown in FIG. 9. The bristle portion 51 of the brush 50 has one tip corner 51*a* carrying a suitable amount of paint. The other tip corner 51*b* is immersed in the waterdrop formed in a selected one of the waterdrop retaining recesses 5 (see FIGS. 1 and 2). The bristle portion 51 thus carrying both paint and water is pressed against and moved on an article surface AS to form a paint line L having a shade-off or gradation portion L1.

Figure 3:
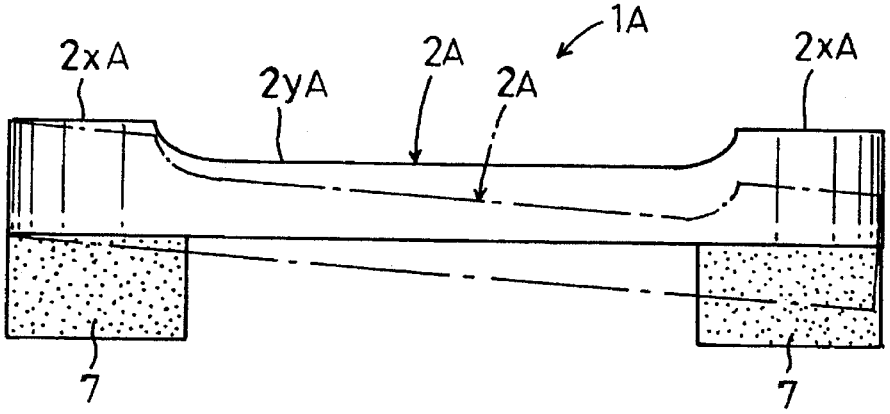
FIG. 3 is a front view showing a waterdrop forming and retaining device according to a second embodiment of the present invention.

FIG. 3 shows a waterdrop device 1A according to a second embodiment of the present invention. The waterdrop device 1A of the second embodiment comprises an elongate upwardly open case 2A which has substantially the same configuration as that of the first embodiment. However, the waterdrop device 1A of the second embodiment differs from that of the first embodiment only in that the underside of the case 2A is provided, at both ends thereof, with respective elastic support members 7. Each of the support members 7 may typically comprise a rubber body or a spring for example.

In use of the waterdrop device 1A of the second embodiment, the user can readily incline the case simply by downwardly pressing either end of the case 2A to compress the corresponding support member 7. Further, the case 2A returns to it horizontal position by the restoring force of the compressed support member 7. As a result, the operation of forming the waterdrops can be conveniently performed and greatly facilitated.

Figure 4:
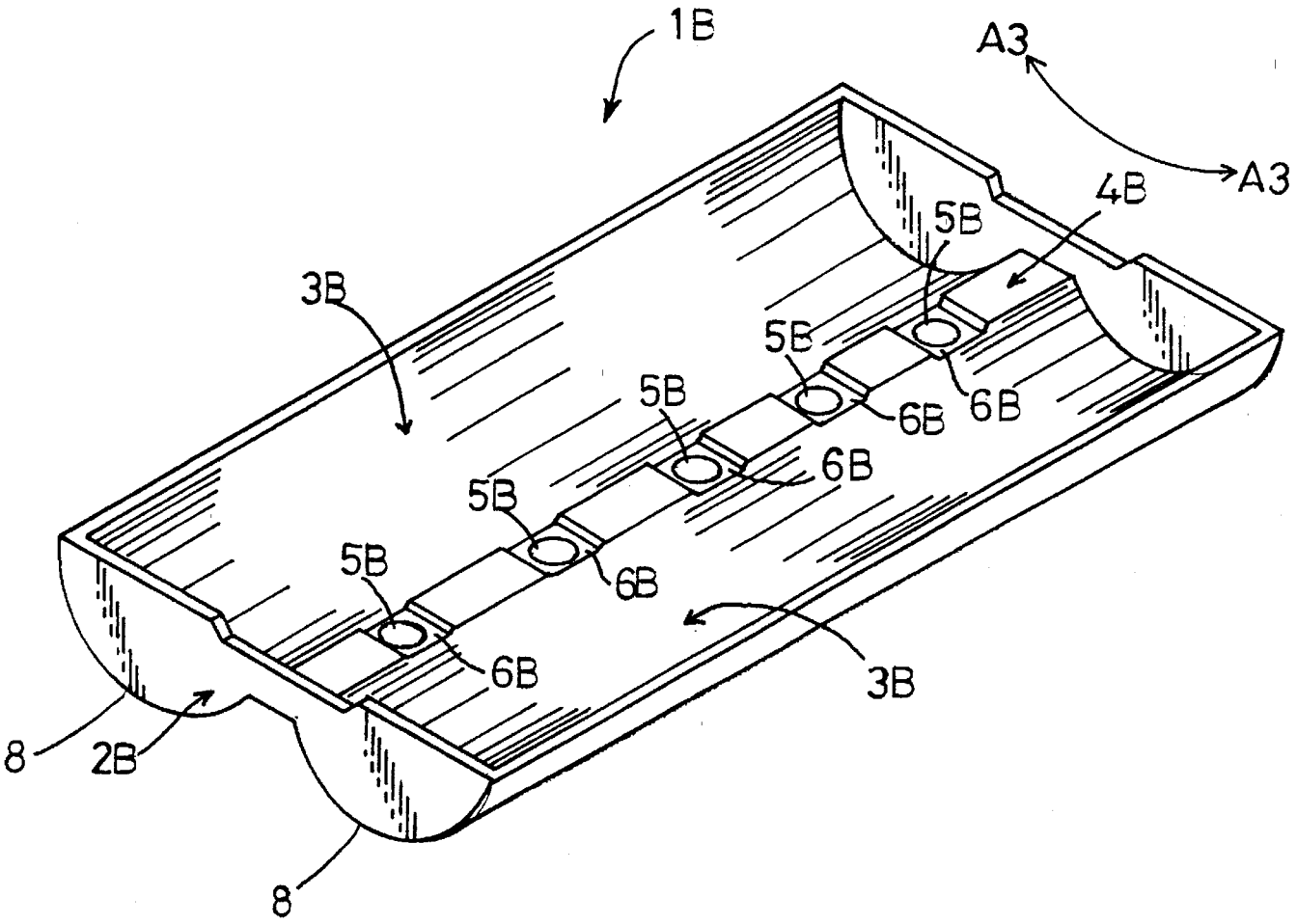
FIG. 4 is a perspective view showing a waterdrop forming and retaining device according to a third embodiment of the present invention.

FIG. 4 shows a waterdrop device 1B according to a third embodiment of the present invention. The waterdrop device 1B of the second embodiment comprises an upwardly open rectangular case 2B which has a pair of longitudinal water reserviors 3B spaced from each other widthwise of the case 2B by a raised intermediate water passage face 4B. The water reserviors 3B in this embodiment are partially cylindrical (half-cylindrical), so that the case 2B provides rounded support portions 8 at the respective water reserviors 3B.

The water passage surface 4, which is relatively narrow, is formed with a plurality of water guide grooves 6B arranged at suitable spacing longitudinally of the water passage surface 4a and connecting between the water reserviors 3B. Each of the water guide grooves 6B is formed with a waterdrop retaining recess 5B which is partially spherical with a small diameter.

In use, the user tilts the case 2B by pivoting it about either one of the rounded support portions 8 which is supported on a table surface (not shown) for example, as indicated by arrows A3–A3 in FIG. 4. As a result, a waterdrop (not shown) is formed and retained in each waterdrop retaining recess 5B upon passage of water from one reservior 3B to the other through the respective water guides 6B. Apparently, the third embodiment is advantageous in that the rounded support portions 8 facilitate pivoting or tilting of the case 2B for waterdrop formation.

Obviously, the waterdrop device 1B of the third embodiment may be modified so that each of the rounded support portions 8 is provided, at both ends thereof, with elastic support members (not shown) which are similar to those shown in FIG. 3.

Figure 5:
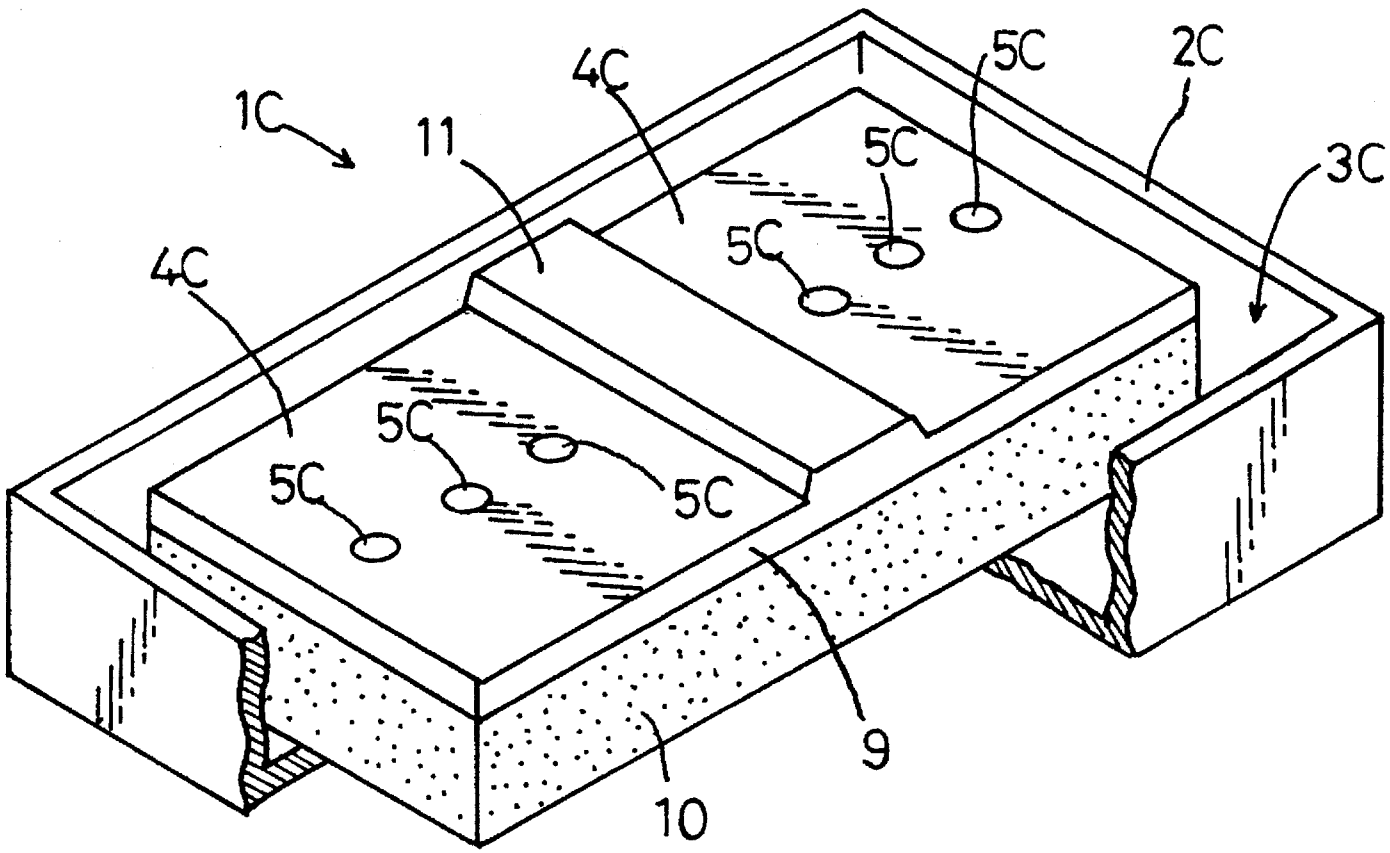
FIG. 5 is a perspective view showing a waterdrop forming and retaining device according to a fourth embodiment of the present invention.

FIG. 5 shows a waterdrop device 1C according to a fourth embodiment of the present invention. The waterdrop device 1C of this embodiment comprises an upwardly open rectangular case 2C which provides a single water reservior 3C as a whole.

A separate movable plate 9 is housed in the case 2C as supported on an elastic absorbent member 10 which may be made of sponge. Thus, the movable plate 9 is movable downward upon compression of the absorbent member 10 and upward upon elastic restoration of the absorbent member 10.

The movable plate 9 provides a water passage surface 4C which is formed with a plurality of waterdrop retaining recesses 5C. Further, the water passage surface 4C is centrally formed with a strip-like projection 11 for conveniently pressing the movable plate 9 downward by a finger.

In use, the single water reservior 3C of the case 2C is supplied with water (not shown) to a level not soaking the water passage surface 4C of the movable plate 9 when the elastic absorbent member 10 is in its natural state. In this condition, the user manually presses the movable plate 9 downward against the elastic force of the absorbent member 10, causing the water passage surface 4C to be immersed in water. Then, the movable plate 9 is liberated to move upward by the elastic restoring force of the absorbent member 10. As a result, a waterdrop is formed and retained in each waterdrop retaining recess 5C.

Preferably, the movable plate 9 may be made of a water-repellant material whose specific weight is smaller than that of water. The use of such a light material is advantageous in that the movable plate 9 floats on the water surface even if the water reservior 3C is loaded with an excessive amount of water, thereby preventing the water passage surface 4C from unexpectedly soaked with water.

The fourth embodiment described above may be modified so that the movable plate 9 is formed with a plurality of minute penetrating pores (not shown) communicating with the respective waterdrop retaining recesses 5C. According to such a modification, when the movable plate 9 is pressed downward, water contained in the elastic absorbent member 10 is squeezed under presser into the respective water drop retaining recesses 5C through the respective pores, thereby forming waterdrops upon subsequent upward movement of the movable plate 9. At this time, excessively squeezed water flows down into the water reservior 3C. Each of the pores may be provided with a check valve for preventing reverse water flow (namely, downward water flow).

Figure 6:
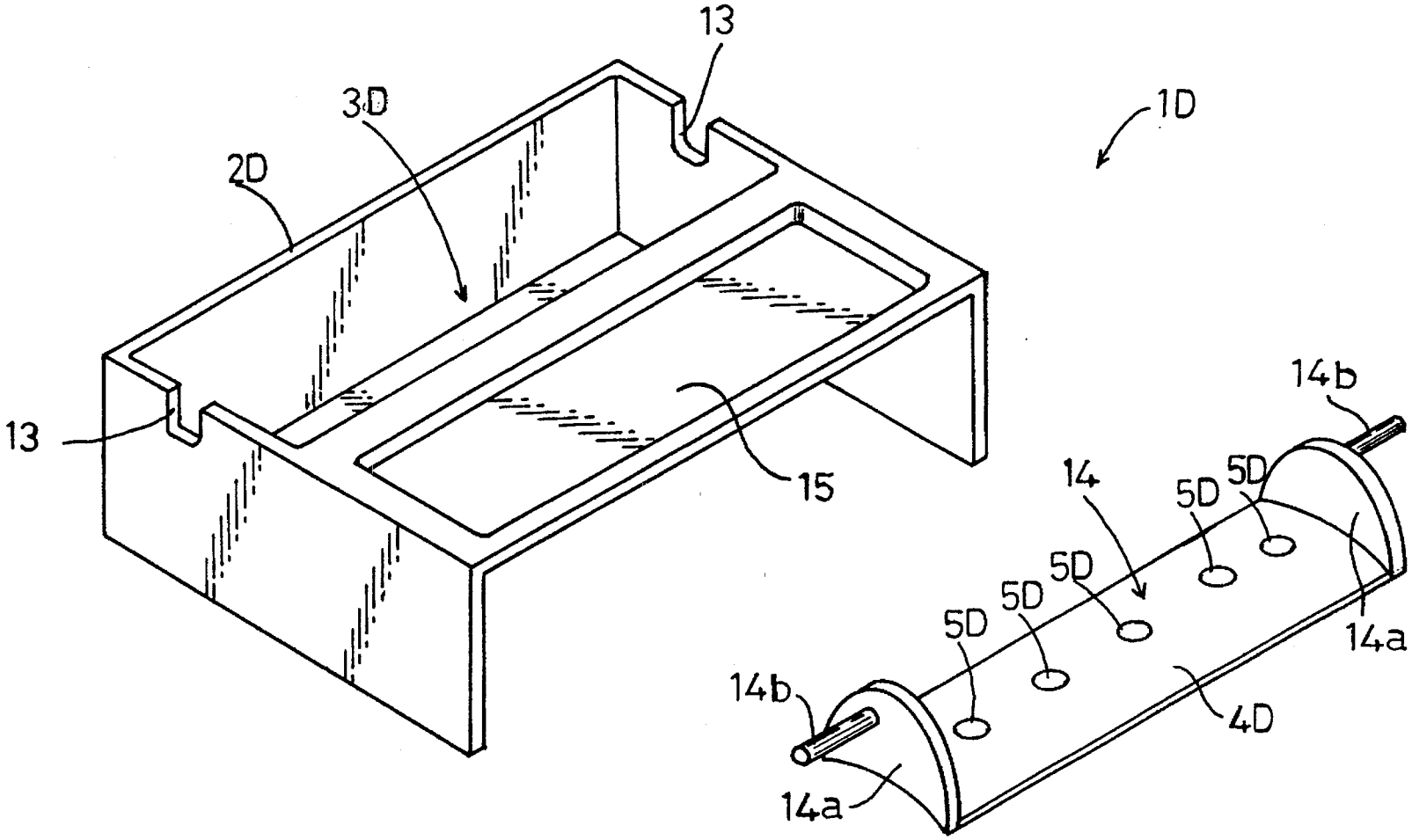
FIG. 6 is a perspective view showing a waterdrop forming and retaining device according to a fifth embodiment of the present invention.

FIG. 6 shows a waterdrop device 1D according to a fifth embodiment of the present invention. The waterdrop device 1D of this embodiment comprises a rectangular case 2D which has a single water reservior 3D and a support shelf 15 arranged side-by-side with but located higher than the water reservior 3D. A separate movable plate 14 is normally placed on the support shelf 15. The support shelf 15 may be preferably depressed for stably supporting the movable plate 14 and for provisionally receiving a small amount of water running off from the movable plate 14.

The movable plate 14 is elongagte and provides a water passage surface 4D which is centrally formed with a longitudinal series of waterdrop retaining recesses 5D. Further, each end of the movable plate 14 is integrally provided with an upward flange **14*a* which is in turn formed integrally with a handle rod 14*b*. Preferably, the cross section of the movable plate 14 may be slightly convex upward, so that water will not remain on the water passage surface 4D except for the waterdrop retaining recesses 5D**.

The water reservior 3D of the case 2D is provided with a pair of cutouts 13 each for removably receiving the corresponding handle rod **14*b*. The length of the handle rod 14*b* is such that it projects laterally from the cutout 13 to enable nipping by fingers when the movable plate 14 is brought into the water reservior 3D**.

In use, the single water reservior 3D of the case 2D is supplied with a suitable amount of water (not shown), and the movable plate 14 normally placed on the support shelf 15 is manually picked up for immersing in the reservior water with the handle rod **14*b* fitted in the corresponding cutout 13. Then, the movable plate 14 is lifted up out of the reservior water and placed again on the support shelf 15. As a result, a waterdrop is formed and retained in each of the waterdrop retaining recesses 5D**.

Figure 7:
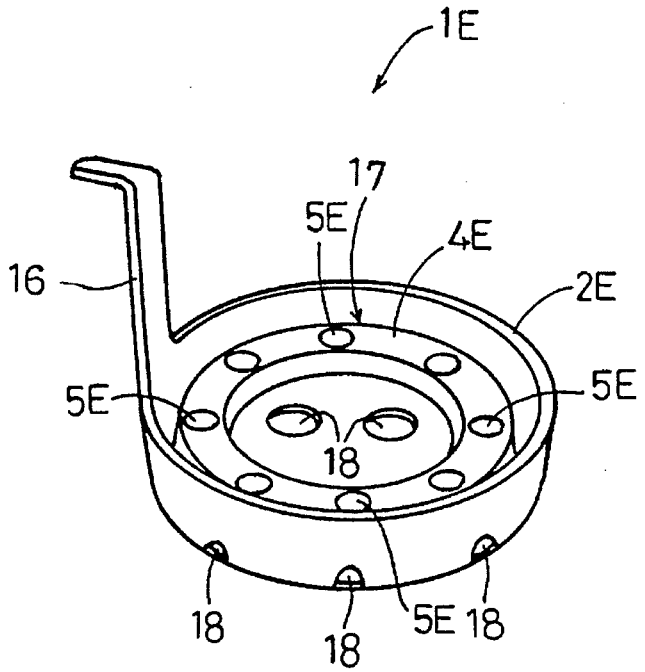
FIG. 7 is a perspective view showing a waterdrop forming and retaining device according to a sixth embodiment of the present invention.
Figure 8:
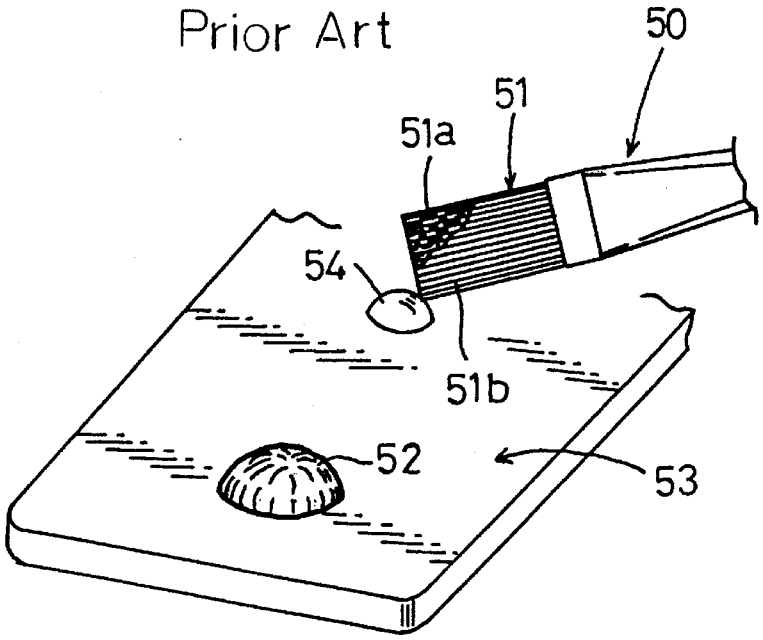
FIG.8 Prior Art
FIG. 8 is a perspective view showing a prior art palette used for forming a waterdrop.

FIG. 7 shows a waterdrop device 1E according to a sixth embodiment of the present invention. The waterdrop device 1E of this embodiment comprises a cup-shaped case 2E which is upwardly open. The case 2E is integrally formed with an upwardly extending handle 16. Further, the bottom of the case 2E is formed with perforations 18.

According to the sixth embodiment, a ring 17 providing an annular water passage surface 4E is fixedly arranged in the cup-shaped case 2E. The annular water passage surface 4E is provided with an annular series of waterdrop retaining recesses 5E.

In use, the case 2E is manually held by the user and immersed in water stored in a separate container (not shown) such as a bucket. Then, the case 2E is lifted up out of the container. As a result, water is drained off through the bottom perforations 18 of the case 2E, whereas a waterdrop is formed and retained in each of the waterdrop retaining recesses 5E.

According to either one of the foregoing embodiments, each of the water retaining recesses 5 . 5E may be optionally shaped (namely, cylindrical, triangular, rectangular, pentagonal, and etc.). Further, the water passage surface 4–4E is made non-water-repellent at the respective waterdrop retaining recesses 5–5E but otherwise water-repellent, so that waterdrops are reliably formed on at the waterdrop retaining recesses 5–5E.

The preferred embodiments of the present invention being thus described, it is obvious that the same may be varied in many ways. Such variations are not to be regarded as a departure from the spirit and scope of the present invention, and all such modifications and variations as would be obvious to those skilled in the art are intended to be included in the scope of the appended claims.

I claim:

1. A device for forming and retaining waterdrops comprising:

a water passage surface for flowing of water;

a plurality of waterdrop retaining recesses formed in the water passage surface;

means for removably supplying water to the water passage surface to form waterdrops at the respective waterdrop retaining recesses;

the water passage surface being formed with a linear water guide groove;

the waterdrop retaining recesses being formed at the water guide groove in a row extending therealong; and the water supplying means comprising two water reservoirs, each water reservoir being provided at a respective end of the water guide groove for containing water at a level lower than the water passage surface.

2. The device according to claim 1, wherein the water passage surface is rendered water-repellent.

3. The device according to claim 1, wherein the water passage surface and the water reservoirs constitute different parts of an integral case.

4. The device according to claim 3, wherein the case is supported by a plurality of elastic support members.

5. A device for forming and retaining waterdrops comprising an upwardly open case which has a pair of water reserviors, the case further having a water guide groove connecting between the pair of water reserviors, the water guide groove being formed with a series of waterdrop retaining recesses spaced along the groove, the water guide groove having a bottom located higher than a bottom portion of each of the water reserviors.

6. A device for forming and retaining waterdrops comprising:

a water passage surface for flowing of water;

a plurality of waterdrop retaining recesses formed in the water passage surface;

means for removably supplying water to the water passage surface to form waterdrops at the respective waterdrop retaining recesses;

the water passage surface being formed with a row of water guide grooves;

the waterdrop retaining recesses being formed at the respective water guide grooves; and the water supplying means comprising two water reservoirs flanking the row of water guide grooves for containing water at a level lower than the water passage surface.

7. A device for forming and retaining waterdrops comprising:

a water passage surface for flowing of water;

a plurality of waterdrop retaining recesses formed in the water passage surface;

means for removably supplying water to the water passage surface to form waterdrops at the respective waterdrop retaining recesses; and the water passage surface being provided by a movable plate supported for movement between a higher first position and a lower second position.

8. The device according to claim 7, wherein the movable plate is supported on an elastic absorbent member.

9. The device according to claim 7, wherein the movable plate is formed with a projection for manually pressing the movable plate downward.

10. The device according to claim 7, wherein the movable plate has a specific weight which is smaller than that of water.

11. A device for forming and retaining waterdrops comprising:

a water passage surface for flowing of water;

a plurality of waterdrop retaining recesses formed in the water passage surface;

a water reservoir for containing water to a level normally lower than the water passage surface;

the water passage surface being provided by a movable plate supported for movement between a first position in the water reservoir and a second position outside but adjacent to the water reservoir.

12. The device according to claim 11, wherein the water reservoir is provided with a pair of cutouts, the movable plate being provided with a corresponding pair of handle rods fitted in the pair of cutouts in the first position of the movable plate.

13. A device for forming and retaining waterdrops comprising:

a water passage surface for flowing of water;

a plurality of waterdrop retaining recesses formed in the water passage surface;

means for removably supplying water to the water passage surface to form waterdrops at the respective waterdrop retaining recesses;

the water passage surface being provided in an annular form by a ring provided in a cup-shaped case;

the case having a bottom Wall formed with a plurality of perforations which work as the water supplying means; and the case being further provided with a handle.

* * * * *